US006517706B1

(12) United States Patent
Pruden et al.

(10) Patent No.: US 6,517,706 B1
(45) Date of Patent: Feb. 11, 2003

(54) HYDROCRACKING OF HEAVY HYDROCARBON OILS WITH IMPROVED GAS AND LIQUID DISTRIBUTION

(75) Inventors: Barry B. Pruden, Sechelt (CA); N. Kelly Benham, Calgary (CA)

(73) Assignee: Petro-Canada, Calgary (CA)

( * ) Notice: Subject to any disclaimer, the term of this patent is extended or adjusted under 35 U.S.C. 154(b) by 0 days.

(21) Appl. No.: 09/561,942

(22) Filed: May 1, 2000

(51) Int. Cl.[7] ..... C10G 47/00; C10G 47/36

(52) U.S. Cl. ..... 208/108; 208/158; 422/214; 422/215

(58) Field of Search ..... 208/108, 158; 422/214, 215

(56) References Cited

U.S. PATENT DOCUMENTS

| | | | | | |
|---|---|---|---|---|---|
| 2,889,270 | A | * | 6/1959 | Marshall et al. | 208/134 |
| 3,475,134 | A | * | 10/1969 | Weber et al. | 261/114.1 |
| 4,312,741 | A | * | 1/1982 | Jacquin | 208/143 |
| 4,478,707 | A | | 10/1984 | Bischoff et al. | |
| 4,639,354 | A | | 1/1987 | Bischoff et al. | |
| 4,702,891 | A | | 10/1987 | Li et al. | |
| 4,874,583 | A | * | 10/1989 | Colvert | 137/533.11 |
| 4,877,587 | A | | 10/1989 | Rhee et al. | |
| 4,911,893 | A | | 3/1990 | Cox | |
| 4,923,838 | A | * | 5/1990 | Khulbe et al. | 208/112 |
| 4,985,209 | A | | 1/1991 | Renard et al. | |
| 5,130,102 | A | | 7/1992 | Jones, Jr. | |
| 5,306,481 | A | | 4/1994 | Mansour et al. | |
| 5,332,552 | A | | 7/1994 | Chang | |
| 5,480,617 | A | | 1/1996 | Uhlemann et al. | |
| 5,755,955 | A | * | 5/1998 | Benham et al. | 208/100 |
| 5,958,220 | A | * | 9/1999 | Reynolds et al. | 208/108 |

FOREIGN PATENT DOCUMENTS

| | | | |
|---|---|---|---|
| CA | 1202588 | * | 4/1986 |

* cited by examiner

*Primary Examiner*—Walter D. Griffin

(57) ABSTRACT

A slurry feed of a heavy hydrocarbon feedstock and coke-inhibiting additive particles together with a hydrogen-containing gas, are fed upward through a confined hydrocracking zone in a vertical, elongated, cylindrical vessel with a generally dome-shaped bottom head. A mixed effluent is removed from the top containing hydrogen and vaporous hydrocarbons and liquid heavy hydrocarbons. The slurry feed mixture and a portion of the hydrogen-containing gas are fed into the hydrocracking zone through an injector at the bottom of the dome-shaped bottom head and the balance of the hydrogen-containing gas is fed into the hydrocracking zone through injection nozzles arranged within of the hydrocracking zone at a location above the slurry-feed injector. The combined slurry feed and hydrogen-containing gas are injected at a velocity whereby the additive particles are maintained in suspension throughout the vessel and coking reactions are prevented.

14 Claims, 4 Drawing Sheets

HYDROCRACKING OF HEAVY HYDROCARBON OILS WITH IMPROVED GAS AND LIQUID DISTRIBUTION

BACKGROUND OF THE INVENTION

This invention relates to a process and apparatus for the treatment of hydrocarbon oils and, more particularly, to the hydroconversion of heavy hydrocarbon oils in the presence of particulate additives, e.g. iron and/or coal additives.

Hydroconversion processes for the conversion of heavy hydrocarbon oils to light and intermediate naphthas of good quality for reforming feedstocks, fuel oil and gas oil are well known. These heavy hydrocarbon oils can be such materials as petroleum crude oil, atmospheric tar bottoms products, vacuum tar bottoms products, heavy cycle oils, shale oils, coal derived liquids, crude oil residuum, topped crude oils and the heavy bituminous oils extracted from oil sands. Of particular interest are the oils extracted from oil sands and which contain wide boiling range materials from naphthas through kerosene, gas oil, pitch, etc., and which contain a large portion of material boiling above 524° C. equivalent atmospheric boiling point.

As the reserves of conventional crude oils decline, these heavy oils must be upgraded to meet the demand for lighter products. In this upgrading, the heavier materials are converted to lighter fractions and most of the sulphur, nitrogen and metals must be removed.

This can be done either by a coking process, such as delayed or fluidized coking, or by a hydrogen addition process such as thermal or catalytic hydrocracking. The distillate yield from the coking process is typically about 80 wt % and this process also yields substantial amounts of coke as by-product.

Work has also been done on a new processing route involving hydrogen addition at high pressures and temperatures and this has been found to be quite promising. In this process, hydrogen and heavy oil are pumped upwardly through an empty tubular reactor in the absence of any catalyst. It has been found that the high molecular weight compounds hydrogenate and/or hydrocrack into lower boiling materials. Simultaneous desulphurization, demetallization and denitrogenation reactions take place.

Additives have been developed which can suppress coking reactions or can remove the coke from the reactor. It has been shown in Khulbe et al, U.S. Pat. No. 4,923,838 issued May 8, 1990 that the formation of carbonaceous deposits in the reaction zone can be substantially reduced by mixing with a heavy oil feedstock a finely divided particulate consisting of carbonaceous particles and particles of an iron compound, e.g. an iron salt or oxide such as iron sulphate. The particles typically have average sizes of less than 10 $\mu$m. Canadian Patent No. 1,202,588 describes a process for hydrocracking heavy oils in the presence of an additive in the form of a dry mixture of coal and iron salt, such as iron sulphate.

A problem in the hydroprocessing of heavy hydrocarbon oil containing finely divided particulate, such as iron sulphate, is to achieve a good gas-liquid distribution in a reaction zone while avoiding coke formation and build-up. Bubble cap distribution plates are commonly used for gas-liquid distribution, e.g. as described in U.S. Pat. 4,874,583 issued Oct. 17, 1989, etc. However, when all gas, liquid and particulate are introduced into a lower region of a reaction zone below a bubble cap distribution plate, there is a problem that the bubble caps are quickly plugged and flow is reduced.

It is the object of the present invention to provide improvements to the mixing of hot hydrogen containing gas with heavy hydrocarbon oil in a hydrocracker and to ensure that additive particles are well mixed into the reactor contents and no settling occurs in the bottom head of the reactor.

SUMMARY OF THE INVENTION

According to the present invention, it has been discovered that further improvements in the hydroprocessing of heavy hydrocarbon oils containing additive particles to suppress coke formation are achieved by the manner in which the heavy hydrocarbon oil and additive particles are introduced into the bottom of a reactor and the manner in which hot hydrogen-containing gas is introduced into the mixture of heavy hydrocarbon oil and additive particles within the reactor.

Thus, one embodiment of the present invention in its broadest aspect relates to a process for hydrocracking a heavy hydrocarbon oil in which (a) a slurry feed comprising a mixture of a heavy hydrocarbon feedstock and from about 0.04 to 4.0% by weight (based on fresh feedstock) of coke-inhibiting additive particles having an average particle size of less than about 30 $\mu$m, preferably less than about 10 $\mu$m, and (b) a hydrogen-containing gas, are passed upwardly through a confined hydrocracking zone in a vertical, elongated, cylindrical vessel with a generally dome-shaped bottom head. The hydrocracking zone is maintained at a temperature between about 350° C. and 600° C. and a pressure of at least about 3.5 MPa. From the top of the hydrocracking zone there is removed a mixed effluent containing a gaseous phase comprising hydrogen and vaporous hydrocarbons and a liquid phase containing heavy hydrocarbons and particulates.

According to the novel features of this process, the slurry feed mixture and a portion of the hydrogen-containing gas (secondary gas) are fed into the hydrocracking zone through a feed injector at the bottom of the dome-shaped bottom head. The balance of the hydrogen-containing gas (main gas) is fed into the hydrocracking zone through a plurality of injection nozzles in the hydrocracking zone at a location above the slurry-feed injector. The temperature of the main hydrogen-containing gas entering through the nozzles is higher than the temperature of the combined slurry feed and hydrogen-containing gas entering through the bottom feed injector, and is generally sufficient to maintain the contents of the hydrocracking zone at a desired operating temperature. The main gas temperature is typically in the range of about 450 to 600° C., preferably about 450 to 540° C. The combined slurry feed and secondary gas entering through the bottom feed injector should enter at a velocity of at least 5 m/s whereby the additive particles are maintained in suspension throughout the reactor vessel and coking reactions are prevented. The combined slurry feed and secondary gas enters the reactor typically at a temperature in the range of about 300 to 430° C., preferably about 350 to 390° C. In a typical process according to the invention, the temperature of the vessel contents varies between about 440° C. in a lower region and 465° C. in an upper region.

The hydrogen-containing gas preferably comprises a recycle gas stream rich in hydrogen typically containing at least 60% hydrogen, and an important feature of this invention is the manner in which this hydrogen gas is introduced into the hydrocracking zone. In order to achieve a good contact between the main recycle hydrogen stream and the heavy hydrocarbon oil in the hydrocracking zone, it is important that the main recycle hydrogen stream be uniformly distributed within the hydrocracking zone in the form of high velocity jets, which provide high shear and mixing, producing small bubbles, to give large surface area for mass transfer from the hydrogen in the bubbles to the bulk liquid above the distributor.

In order to achieve these results, the main gas is preferably injected into the hydrocracking zone through injection nozzles that are arranged to assist in the uniform distribution of the content of the hydrocracking zone. The slurry feed and gas fed in through the bottom feed injector tends to create some central channelling of the flow within the hydrocracking zone. Thus, there is a tendency for much of the gas to flow up the middle of the reactor, with liquid and particulate flowing down the sides. It is, therefore, preferable to provide a lower central set of gas injector nozzles so that the gas flowing from the nozzles is adapted to disperse the central channelling in an outward direction toward the vessel walls. These lower nozzles are preferably arranged in a central circle with the nozzles aimed in an upward and outward direction.

It is also preferable to provide a second set of gas injection nozzles in the vessel at a location above the lower nozzles. These second nozzles are arranged adjacent the wall of the vessel, with the majority being aimed in an upward direction. Some of these second nozzles are also aimed in a downward and inward direction. The upwardly directed second nozzles serve to inhibit flow of liquid and particulates down the vessel walls.

The individual nozzles are typically in the form of small tubes, preferably having an inner diameter of about 6 to 25 mm and lengths of about 50 to 100 mm. The pressure drop in these nozzles is preferably quite substantial, e.g. in the order of 30% of the liquid head in the vessels, and they can be operated at quite high velocities, e.g. in the order of at least 120 m/sec. and as high as 200 m/sec. Such high velocities provide sufficient kinetic energy to cause attrition of the particulate in the vessel. Attrition depends on the square of the velocity and the upper limit of 200 m/sec. is to limit the production of very fine powder. These high velocities do not appear to cause foaming within the vessel.

It is also possible to arrange the nozzles all at the same level and equally spaced across the vessel. In this arrangement, all of the nozzles are in the form of small vertical tubes aimed upwardly. While this arrangement gives a relatively flat gas profile across the hydrocracking zone, there remains some tendency for the gas to channel upwardly in the central region and liquid and particulate to flow down the walls.

Another important feature of this invention is that a portion of the hydrogen-containing gas required for the process is combined with the slurry feed being fed into the bottom of the hydrocracking zone. About 10 to 35% by volume of the total hydrogen-containing gas being fed into the hydrocracking zone is fed in as the secondary hydrogen-containing gas with the slurry feed at the bottom of the reactor. The purpose of adding the hydrogen-containing gas to the slurry feed is to increase the flow velocity, to control coking in a fired liquid heater and to sweep the bottom of the reactor. Introduction of the relatively cooler slurry feed plus secondary hydrogen-containing gas keeps the bottom head cooler to prevent coking reactions and keeps it free of particles which could settle out from the reaction mixture. To achieve this, it has been found that the combined liquid plus gas velocity should be at least 5 m/s at the point of entry. Addition of liquid alone does not create sufficient turbulence.

In order to achieve the desired sweeping effect on the bottom of the reactor, the combined slurry feed and secondary hydrogen-containing gas is preferably fed into the reactor through an injector having a plurality of side openings which direct flow in an outward direction. During upset conditions, or if the reactor is in the coking mode, then mesophase particles can grow and fall through the reactor to the bottom head, where they accumulate. This mesophase is mixed and cooled by the incoming liquid plus gas feed, and can be maintained without coking problems for several hours. At some point it can be removed by dragging. Additionally, in conditions described above, feed flow can be increased, temperature decreased; and cold gas flow can be increased as well to resuspend stubborn solids and mesophase to facilitate dragging and recovery.

A further aspect of the present invention is an apparatus for carrying out the above hydrocracking process. The apparatus includes a vertical, elongated, cylindrical pressure vessel with a generally dome-shaped bottom head. This bottom head includes a feed injector adapted to feed a mixture of feed slurry and hydrogen-containing gas into the bottom of the vessel in an outward and upward direction. A higher circular array of nozzles is positioned adjacent the outer wall of the vessel in the region of the bottom end of the cylindrical portion and conduit means are provided for feeding a hydrogen-containing gas through these nozzles. A lower, axial circular array of nozzles is positioned within the dome-shaped bottom head and having a diameter less than one-half the diameter of the vessel. Conduit means are provided for feeding a hydrogen-containing gas through these nozzles. A reaction product outlet is provided in the top of the vessel. The feed injector and the gas inlet nozzles are arranged to move the content of the vessel upwardly through the vessel in a substantially plug flow with a minimum of settling or channelling.

BRIEF DESCRIPTION OF THE DRAWINGS

For a better understanding of the invention, reference is made to the accompanying drawings in which.

DESCRIPTION OF THE PREFERRED EMBODIMENTS

Figure 1:
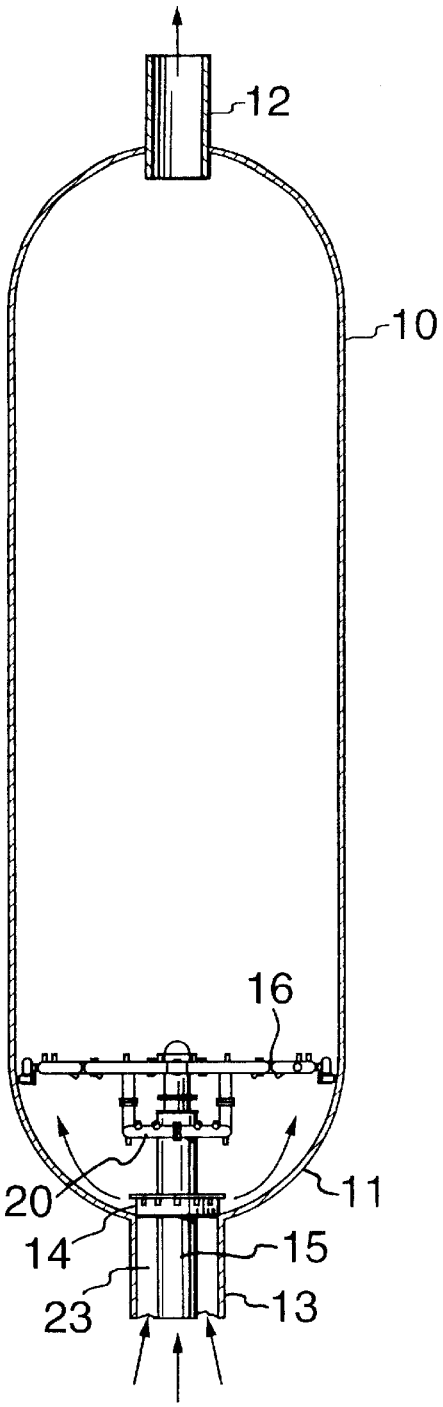
FIG. 1 is a schematic illustration of a hydrocracking vessel.

The system includes a typical cylindrical pressure vessel 10 with a dome shaped bottom head 11 and a reaction product outlet 12 at the top.

The feed inlets at the bottom of the reactor include an outer tube member 13 and an inner concentric tube 15. This inner tube 15 carries hydrogen-containing gas only (main gas) while the annular space 23 between tube 13 and tube 15 carries a mixture of heavy hydrocarbon oil, particulate additive and a portion of hydrogen-containing gas (secondary gas).

The gas injection system can be seen in greater detail in FIGS. 2–6 and it will be seen that the main gas travels up through tube 15 and into a gas distribution manifold. This manifold includes four upper lateral tubes 16 connected to four arcuate gas distribution tubes 17 adjacent the wall of vessel 10. Mounted on these arcuate tubes 17 are a series of nozzles 19*a* and 19*b* with the nozzles 19*a* being aimed in an upward direction and the nozzles 19*b* being aimed in a downward and inward direction. These arcuate tubes 17 are supported within vessel 10 by means of brackets 18 connected to the vessel walls.

Also as part of the gas distribution system, a pair of tubes 21 extend down from a pair of the upper distribution tubes 16 to deliver gas down into a second circular distribution tube 20 having a diameter less than half the diameter of the vessel. This distribution tube 20 has mounted thereon a plurality of upwardly and outwardly directed nozzles 22 as well as two downwardly directed drain tubes 28.

Figure 5:
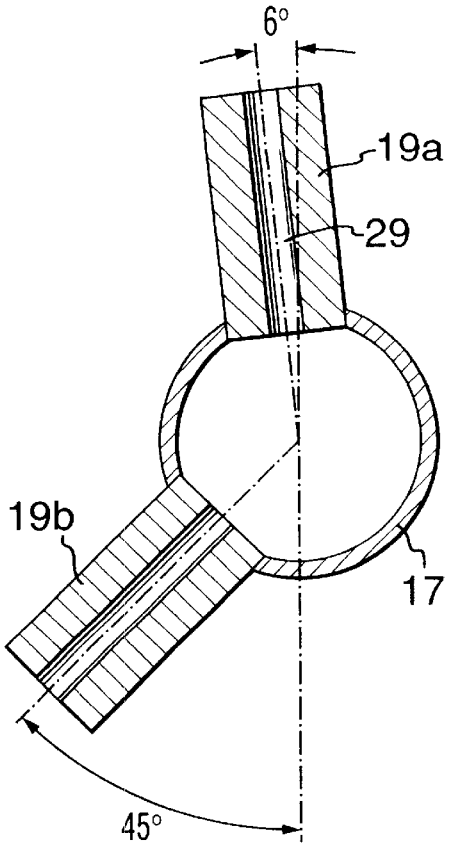
FIG. 5 is a sectional view of upper gas injecting nozzles.
Figure 6:
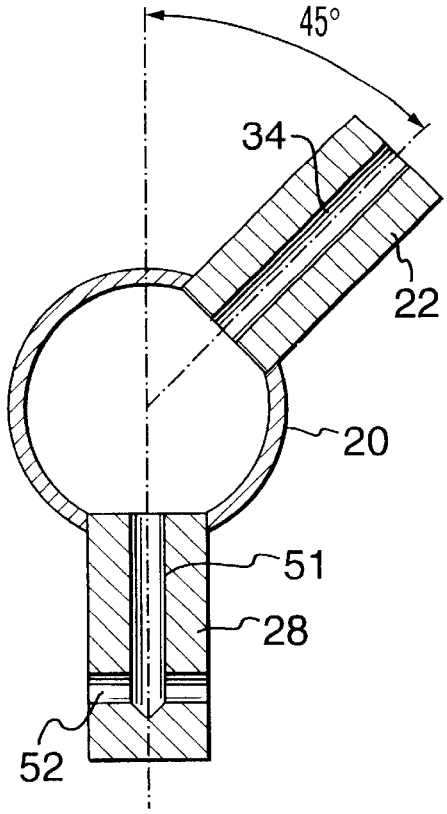
FIG. 6 is a sectional view of lower gas injecting nozzles.

The configurations of the nozzles are shown in greater detail in FIGS. 5 and 6. The nozzles connected to distribution tubes 17 are shown in FIG. 5 and it will be seen that the upwardly directed nozzles 19*a* have a central bore 29 and are preferably directed slightly inwardly from the wall of the vessel by about 6°. The downwardly and inwardly directed nozzles 19*b* are preferably at an angle of about 45° to the wall of the vessel.

The upwardly and outwardly directed nozzles 22 on tube 20 have a central bore 34 and are preferably mounted at an angle of about 45° to the vertical. The downwardly directed drain tubes 28 have a central bore 51 extending down to a lateral bore 52 for discharge of any accumulated fluid in the gas distribution system.

Figure 8:
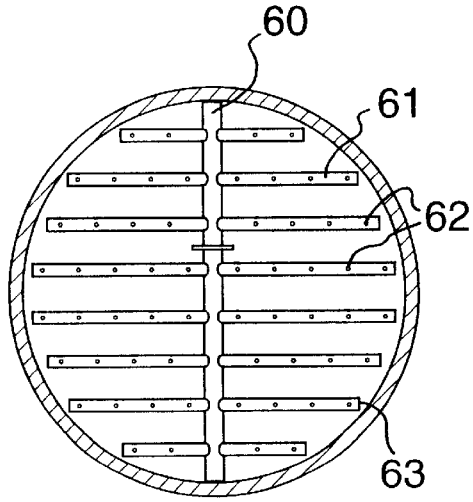
FIG. 8 is a plan view of an alternative gas distributor.

An alternative gas distribution system is shown in FIG. 8. In this arrangement, the nozzles 62 are substantially equally spaced across the reaction zone to give a flat gas profile and are typically spaced at about 2 to 3 nozzles per square foot (about 20 to 30 nozzles per square meter) of reactor cross section. The nozzle diameters and number of nozzles are designed such as to give a velocity of at least about 120 m/sec. and generally the nozzles should have a minimum diameter of about 6 mm to avoid plugging after shutdown.

Usually, the pressure drop in the nozzles should be at least 30% of the head of liquid in the vessel plus the head differential between the two rings, or counterflow may result, this being flow of liquid into the nozzles at the extreme ends of the distributor and out of the nozzles close to the hydrogen supply.

Figure 2:
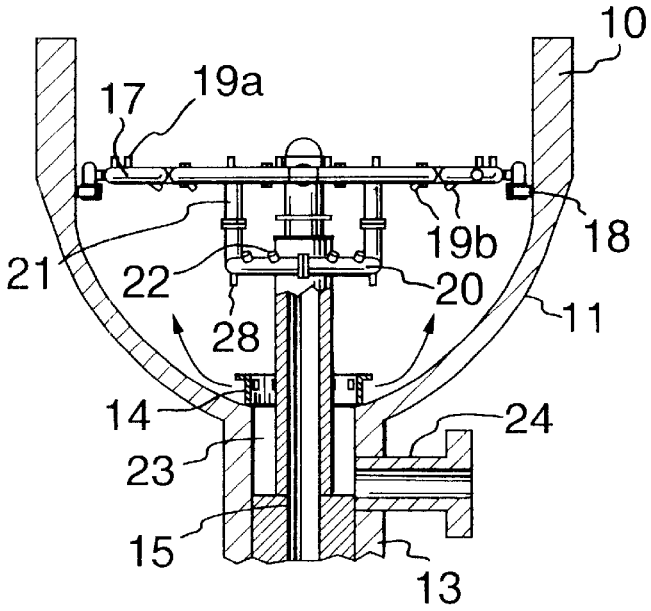
FIG. 2 is a partial sectional view of the bottom end of the reactor.

The bottom feed injector 14 for injecting the mixed liquid/particulate/gas feed consists of a cylindrical wall portion 25 and a top plate 27. In the cylindrical wall are a series of equally spaced slots 26 which direct flow in an outward direction as shown in FIGS. 1 and 2.

Figure 3:
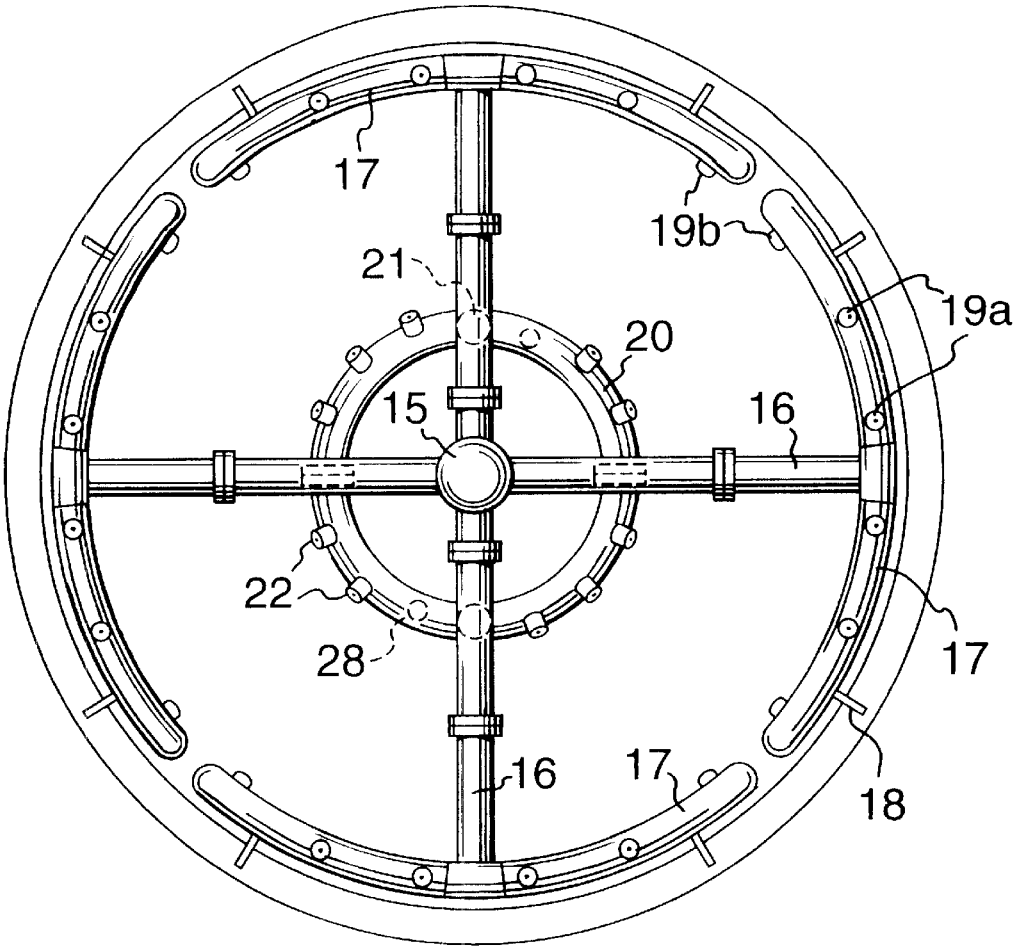
FIG. 3 is a plan view of a gas distributor.
Figure 4:
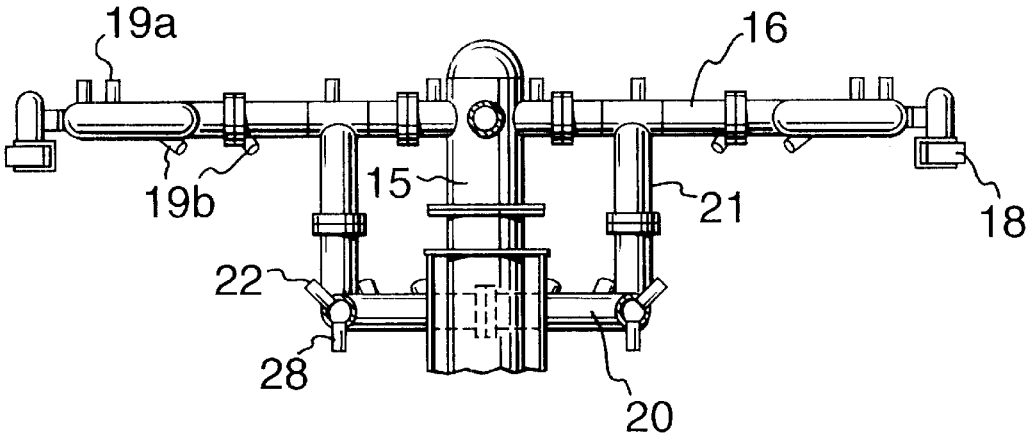
FIG. 4 is a side elevation of a gas distributor.
Figure 7:
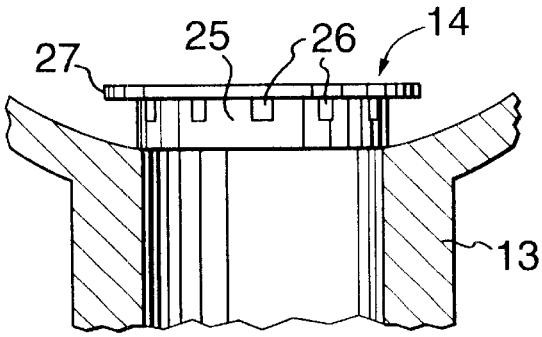
FIG. 7 is a partial sectional view of a slurry feed injector.
Figure 9:
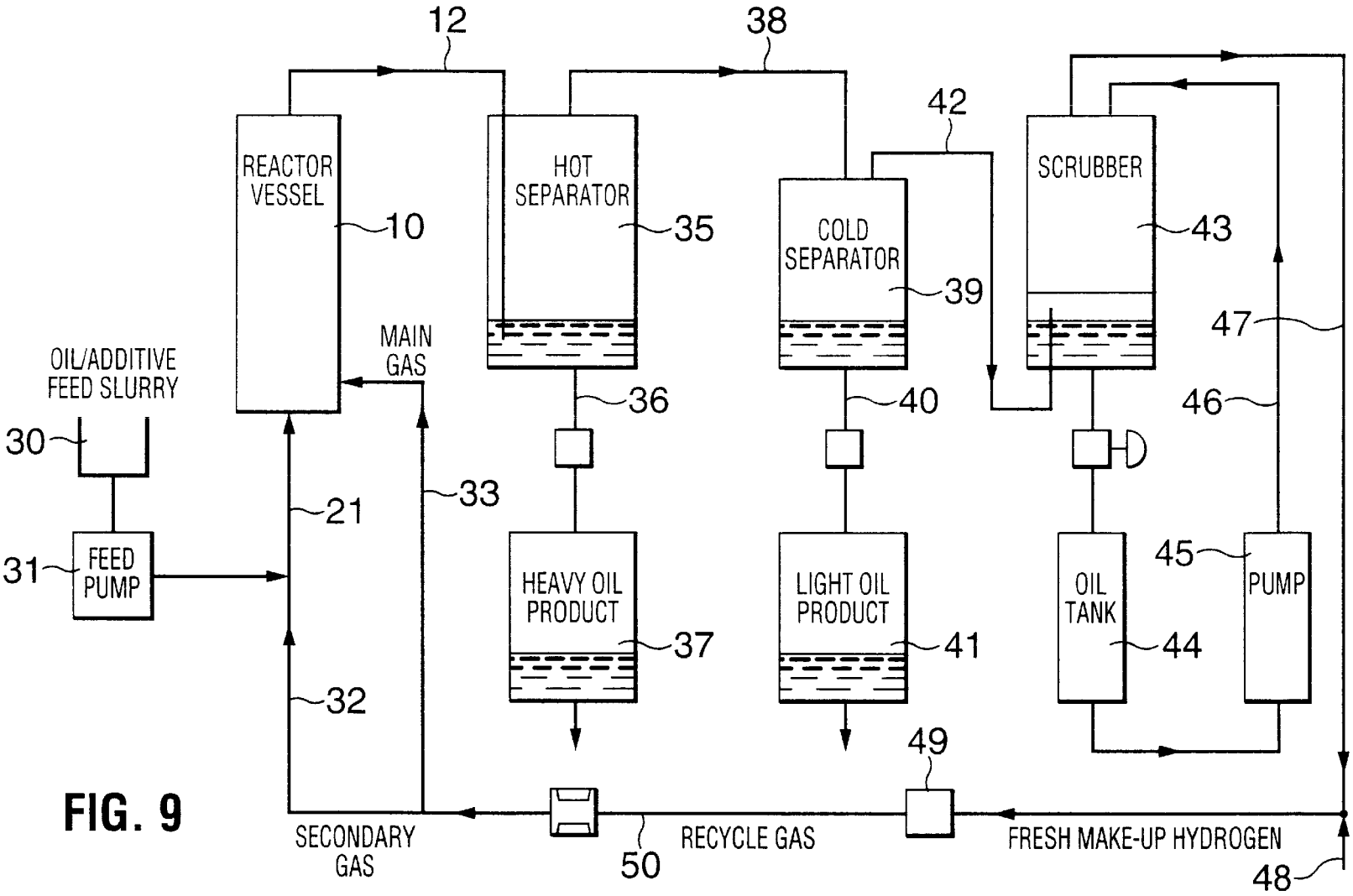
FIG. 9 is a schematic flow sheet showing a typical hydrocracking process.

A typical process to which the present invention is applied is shown in FIG. 9. The iron salt additive is mixed together with a heavy hydrocarbon oil feed in a feed tank 30 to form a slurry. This slurry is pumped by a feed pump 31 through an inlet line 21 into the bottom of a cylindrical reactor vessel 10. Recycled hydrogen 47 and make up hydrogen from line 48 are simultaneously fed into the reactor as recycle gas through line 50. This recycle gas stream 50 is divided into a main gas stream 33 and a secondary gas stream 32. The secondary gas stream 32 is combined with oil/additive feed slurry 30 and fed into the reactor through line 21 and bottom feed injector 14 (FIG. 7). The main gas stream 33 is fed into the reactor through line 15 and nozzles as shown in FIGS. 3 and 4 or FIG. 8. A gas/liquid mixture is withdrawn from the top of the reactor through line 12 and introduced into a hot separator 35. In the hot separator the effluent from vessel 10 is separated into a gaseous stream 38 and a liquid stream 36. The liquid stream 36 is in the form of heavy oil containing particulate which is collected at 37. The gaseous stream from hot separator 35 is carried by way of line 38 into a high pressure-low temperature separator 39. Within this separator the product is separated into a gaseous stream rich in hydrogen which is drawn off through line 42 and an oil product which is drawn off through line 40 and collected at 41.

The hydrogen-rich stream 42 is passed through a packed scrubbing tower 43 where it is scrubbed by means of a scrubbing liquid 44 which is recycled through the tower by means of pump 45 and recycle loop 46. The scrubbed hydrogen-rich stream emerges from the scrubber via line 47 and is combined with fresh make up hydrogen added through line 48 and recycled through line 50 back to reactor 10.

EXAMPLE 1

Tests were conducted on a hydrocracking reactor using the gas injection arrangement shown in FIG. 8 having a nominal throughput of 795 $m^3$/day (5000 BPD). The reactor had a diameter of about 2 m and a height of about 21.3 m and was used with the process of FIG. 9.

The gas distribution system had 60 nozzles spaced at a distance of about 180 mm. Each nozzle had a height of 200 mm, with a bottom inner diameter of about 9 mm and a top inner diameter of about 11 mm. The inner tapered portion extended a distance of 50 mm.

The liquid injector included 12 injection slots, each having an area of 8.3 $cm^2$.

Conditions for a test run were as follows:

The fresh feedstock was Cold Lake refinery vacuum tower bottoms containing 89 wt % of 524° C.+ material and having an API gravity 4.4°API. The additive particles were finely ground iron sulphate monohydrate having average particle sizes less than 10 $\mu$m, these particles being mixed with the feedstock to form a feed slurry. The hydrogen-containing gas was a recycle gas stream containing 85% $H_2$. This gas was divided between a main gas stream feeding directly into the reactor and a secondary gas stream mixed with the feedstock/additive slurry.

(a) The process conditions were as follows:

| | |
|---|---|
| Reactor Pressure | 13.9 MPa |
| Temp. of liquid in reactor | 451° C. |
| Temp. of liquid/additive/gas feed to reactor | 382° C. |
| Temp. of main gas stream to reactor | 493° C. |
| Temp. of cold hydrogen quench | 60° C. |
| Fresh Feed Rate | 3000 BPD |
| Cold hydrogen quench* | 4,000,000 SCFD |
| Main gas flow | 19,000,000 SCFD |
| Secondary gas flow | 10,000,000 SCFD |
| Additive rate | 3 wt % on fresh feed |

This provided a 524° C.+ conversion rate of 90%. After running the above process for 20 days, there was little if any coke build-up in the reactor.

*Cold hydrogen gas was fed directly into the reactor to lower the reactor temperature.

(b) The above procedure was repeated with the secondary gas flow being varied between 5,000,000 and 10,000,000 SCFD. There was found to be poor distribution in the bottom for secondary gas flows below 6,000,000 SCFD.

EXAMPLE 2

A further test was carried out on the same reactor as in Example 1. However, the flow sheet of FIG. 9 was modified to permit recycle of pitch and aromatic oil, as further described in Benham et al., U.S. application Ser. No. 08/576,334, filed Dec. 21, 1995, incorporated herein by reference. Thus, in the flow sheet of FIG. 9, the heavy oil product 37, containing particulate, was fed to a fractionator with a bottom pitch stream boiling above 524° C. and containing particulate being drawn off and recycled as part of the feedstock to reactor 10.

The fractionator also served as a source of aromatic oil, in the form of an aromatic heavy gas oil fraction removed from the fractionator. This gas oil stream, preferably boiling above 400° C., was also recycled as part of the feedstock to reactor 10.

The fresh feedstock was visbreaker vacuum tower bottoms from Flotta Crude having an API gravity of 8.5°API. The additive particles were finely ground iron sulphate monohydrate having average particle sizes less than 10 $\mu$m, these particles being mixed with the feedstock to form a feed slurry. The hydrogen-containing gas was a recycle gas stream containing 85% $H_2$. This gas was divided between a main gas stream feeding directly into the reactor and a secondary gas stream mixed with the feedstock/additive slurry. A cold hydrogen quench was also fed directly into the reactor to lower the temperature.

The process conditions were as follows:

| | |
|---|---|
| Reactor Pressure | 13.9 MPa |
| Temp. of liquid in reactor | 464° C. |
| Temp. of liquid/additive/gas feed to reactor | 403° C. |
| Temp. of main gas stream to reactor | 516° C. |
| Temp. of cold hydrogen quench | 60° C. |
| Fresh Feed Rate | 3218 BPD |
| Aromatics feed | 823 BPD |
| Pitch recycle | 652 BPD |
| Main gas flow | 26,000,000 SCFD |
| Secondary gas flow | 10,200,000 SCFD |
| Cold hydrogen quench | 1,500,000 SCFD |
| Additive rate | 2.3 wt % on fresh feed |

This provided a 524° C.+ conversion rate of 89% with no coke build-up in the bottom of the reactor.

Although this invention has been described broadly and in terms of various specific embodiments, it will be understood that modifications and variations can be made and some elements used without others all within the spirit and scope of the invention, which is defined by the following claims.

We claim:

1. A process for hydrocracking a heavy hydrocarbon oil which comprises passing (a) a slurry feed comprising a mixture of a heavy hydrocarbon oil feedstock a substantial proportion of which boils above 524° C. and from about 0.01–4.0% by weight (based on fresh feedstock) of coke-inhibiting additive particles having an average size of less than about 30 $\mu$m and (b) a hydrogen-containing gas, upward through a confined hydrocracking zone in a vertical, elongated, cylindrical vessel with a dome-shaped bottom head, said hydrocracking zone being maintained at a temperature between about 350° C. and 600° C. and a pressure of at least 3.5 MPa and removing from the top of the hydrocracking zone a mixed effluent containing a gaseous phase comprising hydrogen and vaporous hydrocarbons and a liquid phase comprising heavy hydrocarbons, wherein the slurry feed mixture and a portion of the hydrogen-containing gas are fed into the hydrocracking zone through a feed injector at the bottom of the dome-shaped bottom head and the balance of the hydrogen-containing gas is fed into the hydrocracking zone through a plurality of injection nozzles arranged within the hydrocracking zone at a location above the slurry-feed injector, with the temperature of the hydrogen-containing gas entering through the nozzles being at a temperature higher than the temperature of the combined slurry feed and hydrogen-containing gas entering through said bottom feed injector and the combined slurry feed and hydrogen-containing gas entering through the bottom feed injector at a velocity of at least 5 m/s whereby the additive particles are maintained in suspension throughout the vessel and coking reactions are prevented.

2. A process according to claim 1 wherein the hydrogen containing gas being fed to the hydrocracking zone is a process recycle gas stream containing hydrogen.

3. A process according to claim 1 wherein the hydrogen-containing gas being fed to the injection nozzles has a temperature in the range of about 450 to 600° C. and the combined slurry feed and hydrogen-containing gas being fed in through the bottom feed injector has a temperature in the range of about 300 to 430° C.

4. A process according to claim 1 wherein the hydrogen injection nozzles are arranged in a lower, axial circular array having a diameter less than one half the diameter of the vessel and a higher, axial circular array adjacent the outer wall of the vessel.

5. A process according to claim 4 wherein the lower nozzles are within the dome-shaped bottom head and the higher nozzles are in the region of the bottom end of the cylindrical portion of the vessel.

6. A process according to claim 5 wherein a majority of the higher nozzles are directed upwardly, with the remainder directed downwardly and inwardly.

7. A process according to claim 6 wherein the upwardly directed nozzles are tilted inwardly from the vessel walls by an angle of up to about 6° and the downwardly and inwardly directed nozzles are at an angle of about 45°.

8. A process according to claim 6 wherein the lower nozzles are directed upwardly and outwardly.

9. A process according to claim 8 wherein the lower nozzles are at an angle of about 45°.

10. A process according to claim 2 wherein the hydrogen injection nozzles comprise vertical tubes with top outlets, uniformly spaced across the cross-section of the hydrocracking zone.

11. A process according to claim 10 wherein the hydrogen injection nozzles give a flat gas profile across the hydrocracking zone and a velocity of at least about 120 m/sec.

12. A process according to claim 11 wherein the hydrogen injection nozzle top outlets have a diameter of about 6 to 25 mm.

13. A process according to claim 3 wherein the hydrogen-containing gas combined with the slurry feed comprises about 10–35% by volume of the hydrogen-containing gas being fed to the hydrocracking zone.

14. A process according to claim 13 wherein the combined slurry feed and hydrogen-containing gas is fed into the vessel through an injector having a plurality of side openings which direct flow in an outward direction.

* * * * *